US008613328B2

(12) United States Patent
Meixner et al.

(10) Patent No.: US 8,613,328 B2
(45) Date of Patent: Dec. 24, 2013

(54) HAND-HELD POWER TOOL, IN PARTICULAR A ROTARY HAMMER AND/OR CHISEL HAMMER

(75) Inventors: Gerhard Meixner, Filderstadt (DE); Ralph Dammertz, Mr. Prospect, IL (US); Juergen Lennartz, Ostfildern (DE)

(73) Assignee: Robert Bosch GmbH, Stuttgart (DE)

( * ) Notice: Subject to any disclaimer, the term of this patent is extended or adjusted under 35 U.S.C. 154(b) by 1179 days.

(21) Appl. No.: 11/911,178

(22) PCT Filed: Oct. 27, 2006

(86) PCT No.: PCT/EP2006/067884

§ 371 (c)(1),
(2), (4) Date: Oct. 10, 2007

(87) PCT Pub. No.: WO2007/073956

PCT Pub. Date: Jul. 5, 2007

(65) Prior Publication Data

US 2009/0266572 A1 Oct. 29, 2009

(30) Foreign Application Priority Data

Dec. 22, 2005 (DE) ..... 10 2005 061 399

(51) Int. Cl.
*B25D 9/06* (2006.01)

(52) U.S. Cl.
USPC ..... 173/205; 173/117

(58) Field of Classification Search
USPC ..... 173/117, 217, 216, 205; 74/570.21, 583
See application file for complete search history.

(56) References Cited

U.S. PATENT DOCUMENTS

| | | | | |
|---|---|---|---|---|
| 458,500 | A | 8/1891 | Sander | |
| 1,298,966 | A * | 4/1919 | Knowlson | 310/98 |
| 1,911,814 | A * | 5/1933 | Decker | 74/49 |
| 2,067,886 | A * | 1/1937 | Byford | 74/583 |

(Continued)

FOREIGN PATENT DOCUMENTS

| | | |
|---|---|---|
| DE | 1 298 954 | 7/1969 |
| DE | 2 250 271 | 4/1974 |

(Continued)

*Primary Examiner* — Alexandra Elve
*Assistant Examiner* — Nathaniel Chukwurah
(74) *Attorney, Agent, or Firm* — Michael J. Striker

(57) ABSTRACT

The invention relates to a hand power tool, in particular a drill hammer and/or chipping hammer, comprising a hammer unit (10*a;* 10*b*) for producing a pulse in the direction of a hammer axis (12*a;* 12*b*). Said tool has an axial drive unit (14*a;* 14*b*) with a drive element (16*a;* 16*b*) and a motor unit (18*a;* 18*b*), in addition to a motor shaft (20*a;* 20*b*), which forms an angle (22*a;* 22*b*) not equal to zero with the hammer axis (12*a;* 12*b*) and which co-operates with the axial drive unit (14*a;* 14*b*) by means of a torque transmission wheel (24*a;* 24*b*) of said unit, the axial drive unit (14*a;* 14*b*) being mounted on the opposite side of the torque transmission wheel (24*a;* 24*b*) from the motor unit (18*a;* 18*b*). The driven element (16*a;* 16*b*) of the axial drive unit (14*a;* 14*b*) is mounted directly on the torque transmission wheel (24*a;* 24*b*).

14 Claims, 2 Drawing Sheets

(56) References Cited

U.S. PATENT DOCUMENTS

Figure 1:
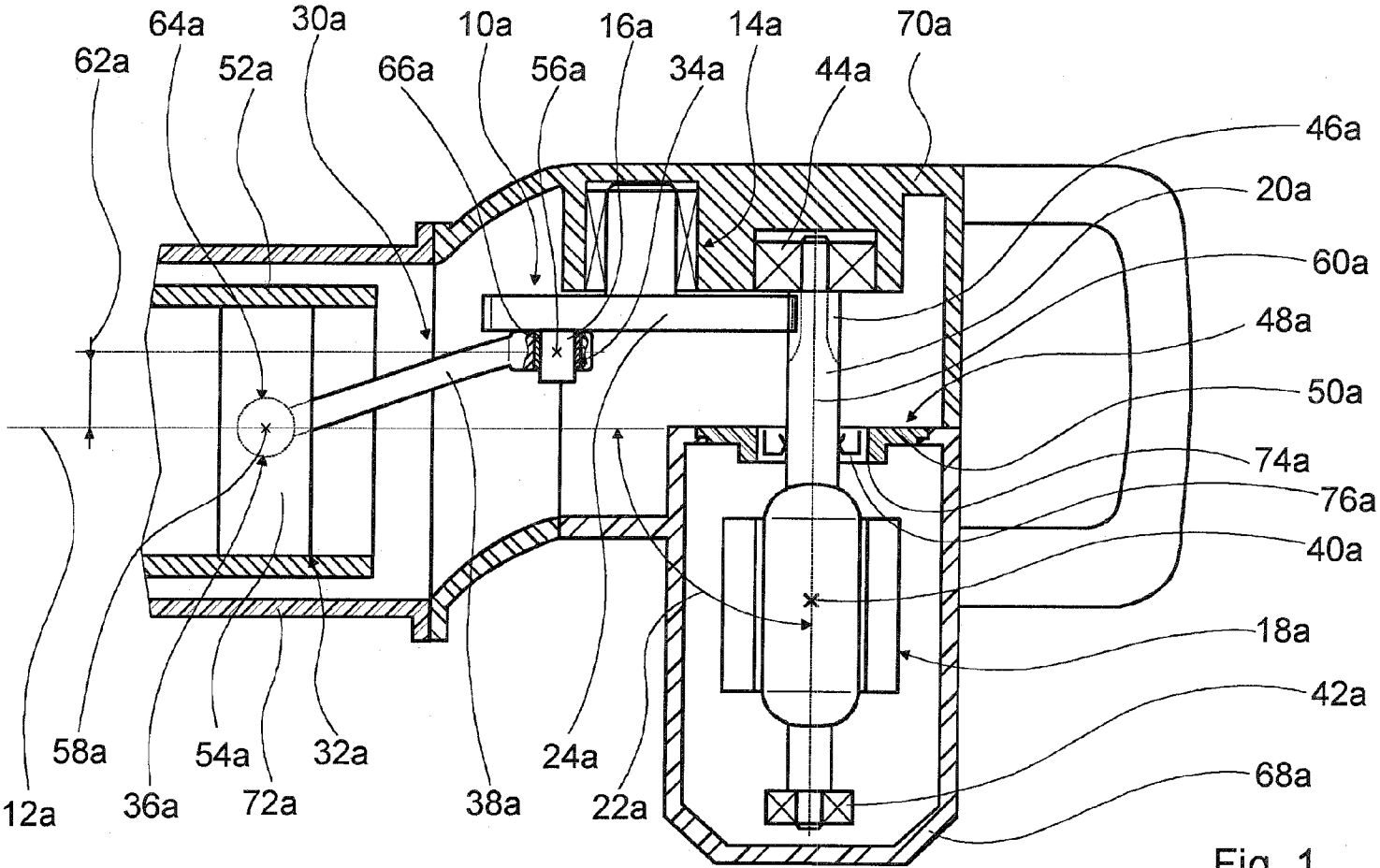

| | | | | | |
|---|---|---|---|---|---|
| RE20,365 | E | * | 5/1937 | Baker | 173/76 |
| 2,873,735 | A | * | 2/1959 | Deliot | 173/201 |
| 3,114,423 | A | * | 12/1963 | Naslund | 173/97 |
| 3,305,031 | A | * | 2/1967 | Bez et al. | 173/115 |
| 3,921,729 | A | * | 11/1975 | Schmuck | 173/14 |
| 4,487,270 | A | | 12/1984 | Huber | |
| 7,048,076 | B2 | | 5/2006 | Cecchin et al. | |
| 2004/0182589 | A1 | * | 9/2004 | Cecchin et al. | 173/216 |

FOREIGN PATENT DOCUMENTS

| | | |
|---|---|---|
| DE | 33 14 414 | 10/1984 |
| DE | 39 10 599 | 10/1990 |
| DE | 298 00 248 | 5/1999 |
| DE | 199 13 020 | 10/2000 |
| DE | 102 59 566 | 7/2004 |
| EP | 0 583 710 | 2/1994 |
| FR | 2 517 134 | 5/1983 |
| GB | 2 048 753 | 12/1980 |
| GB | 2 397 857 | 8/2004 |

* cited by examiner

HAND-HELD POWER TOOL, IN PARTICULAR A ROTARY HAMMER AND/OR CHISEL HAMMER

RELATED ART

The present invention is directed to a hand-held power tool according to the definition of the species in claim 1.

Publication DE 102 59 566 A1 makes known a hand-held power tool designed as a chisel hammer that includes an impact mechanism for generating an impulse in the direction of an axis of impact. The impact mechanism includes an axial drive unit formed by an eccentric unit, with a driven element formed by an eccentric peg. The hand-held power tool also includes a motor unit designed as an electric motor, the motor shaft of which forms an angle of 90° with the axis of impact, and which is operatively connected with the axial drive unit via a torque transmission wheel of the axial drive unit, the torque transmission unit being designed as a gear wheel. The axial drive unit is supported on the side of the gearwheel facing away from the motor unit. On a side facing the motor unit, the gearwheel is abutted by a crankshaft of the axial drive unit and/or the eccentric unit, on the end face—facing the motor unit—of which the driven element or eccentric peg is located.

ADVANTAGES OF THE INVENTION

The present invention is directed to a hand-held power tool, in particular a rotary hammer and/or chisel hammer, with an impact mechanism for generating an impulse in the direction of an axis of impact, which includes an axial drive unit with a driven element, and with a motor unit and a motor shaft that form an angle with the axis of impact not equal to zero, and which is operatively connected with the axial drive unit via a torque transmission wheel of the axial drive unit, the axial drive unit being supported on the side of the torque transmission wheel facing away from the motor unit.

It is provided that the driven element of the axial drive unit is located directly on the torque transmission wheel. An "axial drive unit" refers, in particular, to a unit that converts a rotational motion into an axial motion, such as a cam mechanism and/or, particularly advantageously, an eccentric unit, which may be realized with a simple, space-saving, and robust design. A "driven element" refers to an element that brings about at least a portion of a conversion of the rotational motion to axial motion via, in particular, its shape and/or, in particular, its location. Examples include an eccentric peg or a cam with a matching eccentric recess, etc., and which forms an interface with a transmission unit provided for transmitting a drive force of the axial drive unit to a piston unit, such as a connecting rod unit and/or a push unit that are/is guided on a curved path of the axial drive unit. A "torque transmission wheel" refers, in particular, to a wheel that is provided to transmit torque, such as a wheel that is provided for coupling with a belt, and/or, particularly preferably, a gearwheel, etc. Furthermore, a location "directly next to the torque transmission wheel" refers, in particular, to a design without an intermediate shaft, such as a crankshaft in particular, and/or to a location next to a torque transmission element of the torque transmission wheel, of a tooth system in particular, with a separation in the axial direction of the torque transmission wheel that is less than its extension in the axial direction. The driven element may be designed as a single component or with multiple components, and it may include connecting means in particular, such as sleeves, which may be provided to be fastened to the torque transmission wheel and/or for damping, etc. Particularly preferably, however, the driven element is designed as a single piece and is integrally moulded directly with the torque transmission wheel, or it is mounted directly thereon. "Provided" is intended to mean, in particular, specially equipped and/or designed.

An inventive embodiment of this type saves installation space and weight, and a particularly compact design may be attained, in particular when an axial drive unit is supported on one side, relative to the torque transmission wheel in particular.

Furthermore, components, installation space, weight, assembly expense and costs may be saved when the hand-held power tool includes a rotary drive unit that is provided for rotationally driving a tool and that is designed at least partially as a single piece with the axial drive unit, preferably when the torque transmission wheel of the axial drive unit is supported on a shaft of the rotary drive unit.

In a further embodiment of the present invention, it is provided that the impact mechanism includes a transmission unit, which is provided to transmit a drive force from the axial drive unit to a piston unit, the transmission unit including vertically offset joints. "Displaced vertically" refers, in particular, to a distance in a direction that is not an axial direction or an impact direction, and which extends in the direction of a bearing axis of the hand-held power tool, e.g., particularly preferably in the direction of a motor axis or an axis of rotation of the motor shaft. The distance between the joints and/or between the centers of the joints is preferably greater than half of a longitudinal extension of at least one joint, and particularly preferably, is greater than an entire longitudinal extension of a joint. A "joint" refers, in particular, to a point at which the transmission unit is coupled with the axial drive unit, and to a point at which the transmission unit is coupled with the piston unit. With an inventive embodiment of this type, a particularly flexible design of installation space may be attained, and installation space—height, in particular—may be saved overall.

Vertically offset joints may be attained using a simple design and in a cost-favorable manner when the transmission unit includes at least one transmission element, which has—in at least one subregion—an orientation that extends diagonally to the axis of impact and brings about a vertical offset between the joints.

When the motor unit is supported via motor bearing points before and after—in the direction of the motor shaft—its center of mass, a large distance between the motor bearing points and the motor unit may be attained, and the motor unit may be advantageously supported with bearings—that are sizeable in a cost-favorable manner—in particular when the motor unit includes a pinion located between—in the direction of the motor shaft—the motor bearing points. A "motor unit" refers, in particular, to a unit in which one form of energy, such as flow energy and preferably electrical energy, is converted to rotational energy, such as a rotor and a stator, in particular, of an electric motor, etc. "Motor bearing points" refers in particular to bearing points at which the parts of the motor unit are supported, such as the stator and/or rotor, in particular, of an electric motor, e.g., via a motor shaft, etc.

It is further provided that the hand-held power tool includes a sealing unit located between the motor bearing points in the direction of the motor shaft. A "sealing unit" refers, in particular, to a unit that seals off a motor compartment from lubricant. A sealing unit located in this position may have a particularly simple design, in particular when it includes an intermediate cover.

DRAWING

Further advantages result from the description of the drawing, below. Exemplary embodiments of the present invention are shown in the drawing. The drawing, the description and the claims contain numerous features in combination. One skilled in the art will also advantageously consider the features individually and combine them to form further reasonable combinations.

Figure 2:
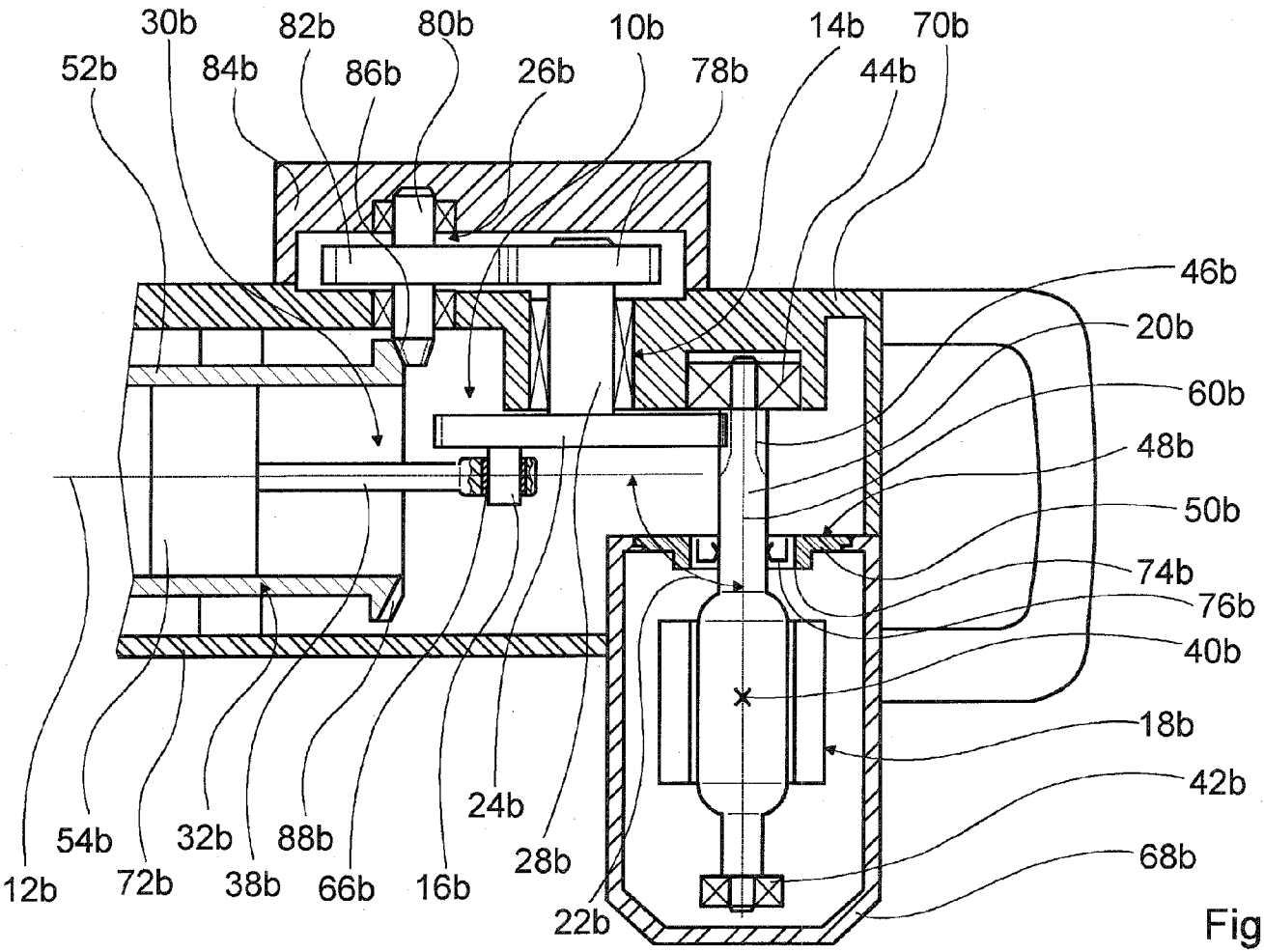

FIG. 1 shows a schematicized longitudinal sectional view of a hand-held power tool designed as a chisel hammer, and FIG. 2 shows a schematicized longitudinal sectional view of a hand-held power tool designed as a rotary hammer.

DESCRIPTION OF THE EXEMPLARY EMBODIMENTS

FIG. 1 shows a schematicized longitudinal sectional view of a hand-held power tool designed as a chisel hammer with an impact mechanism 10*a*, which serves to generate an impulse in the direction of an axis of impact 12*a*. Impact mechanism 10*a* includes an axial drive unit 14*a* designed as an eccentric unit, with a driven element 16*a* designed as an eccentric peg. Impact mechanism 10*a* also includes a transmission unit 30*a*, which is provided to transmit a drive force from driven element 16*a* of axial drive unit 14*a* to a piston unit 32*a* and/or to a piston 54*a*, which is guided in a hammer tube 52*a*. Transmission unit 30*a* is formed essentially by a transmission element 38*a* designed as a connecting rod, and includes vertically offset joints 34*a*, 36*a* formed by connecting rod ends. Joints 34*a*, 36*a*, i.e., their centers 56*a*, 58*a*, formed by the connecting rod ends are separated—in the direction of a motor axis 60*a* or an axis of rotation of a motor shaft 20*a* of a motor unit 18*a* designed as an electric motor—by a distance 62*a* that preferably corresponds to one-half of an extension of a joint 34*a*, 36*a* in the direction of motor axis 60*a*. To attain a vertical offset essentially from joint 34*a* facing axial drive unit 14*a* to joint 36*a* facing piston unit 32*a*, transmission element 38*a* is orientated diagonally to axis of impact 12*a*. It would also be feasible in principle, however, for transmission element 38*a* to be designed coaxial or parallel with axis of impact 12*a*, as viewed perpendicularly to motor axis 60*a* and/or in the side view shown.

The hand-held power tool has an L shape, in which motor axis 60*a* and/or motor shaft 20*a* form(s) an angle 22*a* of 90° with axis of impact 12*a*. Other angles that are not zero and that appear reasonable to one skilled in the art are also feasible, such as angles between 30° and 150° in particular. An orientation of motor shaft 20*a* that is coaxial or parallel with axis of impact 12*a* is considered to be an angle equal to zero.

Transmission element 38*a* is coupled with piston 54*a* in joint 36*a* facing piston unit 32*a* via a spherical head mounting 64*a*, and it is coupled in joint 34*a* facing axial drive unit 14*a* via a ball journal bearing 66*a* with driven element 16*a*—designed as an eccentric peg—of axial drive unit 14*a*.

Motor unit 18*a* is located in a motor housing 68*a*, which, in the direction toward axial drive unit 14*a*, abuts a transmission housing 70*a* formed by a first component, and, in the direction toward piston unit 32*a*, abuts a hammer tube housing 72*a* formed by a further component. As an alternative, transmission housing 70*a* and hammer tube housing 72*a* may also be designed as single pieces. A shell design is also possible, in which the functional assemblies are enclosed—either entirely or partially—by two half shells. Motor unit 18*a* could also be accommodated in a half shell.

Motor shaft 20*c* extends beyond a core of motor unit 18*a* in both directions and is supported at one end—facing away from axial drive unit 14*a*—in motor housing 68*a* via a first motor bearing point 42*a*, and, at an end facing axial drive unit 14*a*, is supported via a second motor bearing point 44*a* and, in fact starting from motor unit 18*a* designed as an electric motor in the axial direction of motor axis 60*a* behind a motor pinion 46*a* integrally moulded with motor shaft 20*a* and behind a torque transmission wheel 24*a* of axial drive unit 14*a*, which meshes with motor pinion 46*a* and is designed as a spur gear. As an alternative, motor bearing point 44*a* could be located in front—starting at motor unit 18*a* and extending along motor shaft 20*a*—of motor pinion 46*a*. Motor unit 18*a* is supported by motor bearing points 42*a*, 44*a* before and after—in the direction of motor shaft 20*a*—of its center of mass 40*a*.

The hand-held power tool includes a sealing unit 48*a*, which is located between—in the direction of motor shaft 20*a*—motor bearing points 42*a*, 44*a* in motor housing 68*a*, and which includes an intermediate cover 50*a* with a recess 74*a*, through which motor shaft 20*a* is guided. An annular seal 76*a*, which serves as a seal between motor shaft 20*a* and intermediate cover 50*a*, is located in recess 74*a*. Annular seal 76*a* seals off a motor compartment in motor housing 68*a* from a transmission compartment in transmission housing 70*a*. As an alternative, a sealing ring could also be installed directly in a motor housing—which would be designed accordingly—and/or directly in a transmission housing.

Axial drive unit 14*a* and/or the eccentric are/is supported in transmission housing 70*a* on one side—relative to torque transmission wheel 24*a*—on a side of torque transmission wheel 24*a* facing away from motor unit 18*a*, while, on the side of torque transmission wheel 24*a* facing motor unit 18*a*, driven element 16*a*—which is designed as a single-pieced eccentric peg—of axial drive unit 14*a* is located directly on torque transmission wheel 24*a* and is fastened directly thereto.

A further exemplary embodiment is shown in FIG. 2. Components and functions that are essentially the same are labeled with the same reference numerals, but appended with a or b, to differentiate the two exemplary embodiments. The description below is essentially limited to the differences from the exemplary embodiment in FIG. 1. With regard for the components, features, and functions that are identical, reference is made to the description of the exemplary embodiment in FIG. 1.

FIG. 2 shows a schematicized longitudinal sectional view of a hand-held power tool designed as a rotary hammer, which—unlike the hand-held power tool shown in FIG. 1—also includes a rotary drive unit 26*b*, which is provided to rotationally drive a tool, i.e., a drilling tool. Rotary drive unit 26*b* is designed partially as a single piece with an axial drive unit 14*b*. In fact, a torque transmission wheel 24*b* of axial drive unit 14*b* is provided as the drive element of rotary drive unit 26*b*. Torque transmission wheel 24*b*, which is designed as a spur gear, is mounted on a shaft 28*b* of rotary drive unit 26*b*, on the end—facing away from torque transmission wheel 24*b*—of which an intermediate wheel 78*b* is mounted. During operation, torque is transmitted via shaft 28*b* from torque transmission wheel 24*b* to intermediate wheel 78*b*.

Intermediate wheel 78*b* meshes with a gearwheel 82*b* that is also mounted on a shaft 80*b*. On a side facing away from a hammer tube 52*b*, shaft 80*b* is supported in a cover 84*b*, and, on a side facing hammer tube 52*b*, it is supported in a hammer tube housing 72*b*. A pinion 86*b* is integrally moulded with an end facing hammer tube 52*b*. Pinion 86*b* meshes with a crown wheel 88*b* integrally moulded with hammer tube 52*b*. As an alternative, crown wheel 88*b* could also be designed as a component that is separate from hammer tube 52*b*, that could be secured to hammer tube 52*b* or connected with hammer tube 52*b* via interlocking.

REFERENCE NUMERALS

10 Impact mechanism
12 Axis of impact

14 Axial drive unit
16 Driven element
18 Motor unit
20 Motor shaft
22 Angle
24 Torque transmission wheel
26 Rotary drive unit
28 Shaft
30 Transmission unit
32 Piston unit
34 Joint
36 Joint
38 Transmission element
40 Center of mass
42 Motor bearing point
44 Motor bearing point
46 Motor pinion
48 Sealing unit
50 Intermediate cover
52 Hammer tube
54 Piston
56 Center
58 Center
60 Motor axis
62 Distance
64 Spherical head mounting
66 Ball journal bearing
68 Motor housing
70 Transmission housing
72 Hammer tube housing
74 Recess
76 Annular seal
78 Intermediate wheel
80 Shaft
82 Gearwheel
84 Cover
86 Pinion
88 Crown wheel

What is claimed is:

1. A hand-held power tool, comprising:

an impact mechanism (10*a*) for producing an impulse in the direction of an axis of impact (12*a*);

an axial drive unit (14*a*) with a driven element (16*a*);

a motor unit (18*a*); and a motor shaft (20*a*), which forms an angle (22*a*) not equal to zero with the axis of impact (12*a*);

wherein the motor shaft (20*a*) cooperates with the axial drive unit (14*a*) via a torque transmission wheel (24*a*) of the axial drive unit (14*a*), wherein the axial drive unit (14*a*) is supported on the side of the torque transmission wheel (24*a*) facing away from the motor unit (18*a*), wherein the axial drive unit (14*a*) is formed by an eccentric unit, wherein the driven element (16*a*) of the axial drive unit (14*a*) is located directly on the torque transmission wheel (24*a*), wherein the driven element (16*a*) of the axial drive unit (14*a*) is located in a plane perpendicular to a rotation axis of the torque transmission wheel (24*a*), wherein the impact mechanism (10*a*) includes a transmission unit (30*a*) and a piston unit (32*a*), wherein the transmission unit (30*a*) is provided to a transmit force from the axial drive unit (14*a*) to the piston unit (32*a*), wherein the transmission unit (30*a*) includes vertically offset joints (34*a*; 36*a*), wherein the vertical offset joints (34*a*; 36*a*) are located in a plane perpendicular to the plane in which the driven element (16*a*) of the axial drive unit (14*a*), and wherein the transmission unit (30*a*) includes at least one transmission element (38*a*), which has, in at least one subregion, an orientation that extends diagonally to the axis of impact (12*a*) and results in a vertical offset between the vertical offset joints (34*a*; 36*a*).

2. The hand-held power tool as recited in claim 1, wherein the axial drive unit (14*a*) is supported on one side.

3. The hand-held power tool as recited in claim 1, wherein the motor unit (18*a*) is supported via motor bearing points (42*a*, 44*a*) which are located along a direction of the motor shaft (20*a*) before and after a its center of mass (40*a*) of the motor unit (18*a*).

4. The hand-held power tool as recited in claim 3, wherein the motor unit (18*a*) includes a motor pinion (46*a*) located between the motor bearing points (42*a*, 44*a*) in the direction of the motor shaft (20*a*).

5. The hand-held power tool as recited in claim 3, characterized by a sealing unit (48*a*), which is located between, in the direction of the motor shaft (20*a*), the motor bearing points (42*a*, 44*a*).

6. The hand-held power tool as recited in claim 5, wherein the sealing unit (48*a*) includes an intermediate cover (50*a*).

7. A hand-held power tool, comprising:

an impact mechanism (10*b*) for producing an impulse in the direction of an axis of impact (12*b*);

an axial drive unit (14*b*) with a driven element (16*b*);

a motor unit (18*b*); and a motor shaft (20*b*), which forms an angle (22*b*) not equal to zero with the axis of impact (12*b*);

wherein the motor shaft (20*b*) cooperates with the axial drive unit (14*b*) via a torque transmission wheel (24*b*) of the axial drive unit (14*b*), wherein the axial drive unit (14*b*) is supported on the side of the torque transmission wheel (24*b*) facing away from the motor unit (18*b*), wherein the driven element (16*b*) of the axial drive unit (14*b*) is located directly on the torque transmission wheel (24*b*), wherein the motor unit (18*b*) is supported via motor bearing points (42*b*; 44*b*), which are located in a direction of the motor shaft (20*b*) before and after a center of mass (40*b*) of the motor unit (18*b*), and wherein the motor unit (18*b*) includes a motor pinion (46*b*), which is located along the direction of the motor shaft (20*b*) between the motor bearing points (42*b*; 44*b*).

8. The hand-held power tool as recited in claim 7, wherein the axial drive unit (14*b*) is supported on one side.

9. The hand-held power tool as recited in claim 7, further comprising a rotary drive unit (26*b*), which is provided for rotationally driving a tool, and which is constructed at least partially as a single piece with the axial drive unit (14*b*).

10. The hand-held power tool as recited in claim 9, wherein the torque transmission wheel (24*b*) of the axial drive unit (14*b*) is provided as a means to drive the rotary drive unit (26*b*).

11. The hand-held power tool as recited in claim 10, wherein the torque transmission wheel (24*b*) of the axial drive unit (14*b*) is supported on a shaft (28*b*) of the rotary drive unit (26*b*).

12. The hand-held power tool as recited in claim 7, wherein the axial drive unit (14*b*) is formed by an eccentric unit.

13. The hand-held power tool in claim 7, further comprising a sealing unit (48*b*), which is located along the direction of the motor shaft (20*b*) the motor bearing points (42*b*, 44*b*).

14. The hand-held power tool as recited in claim 13, wherein the sealing unit (48*b*) includes an intermediate cover (50*b*).

* * * * *